US006691335B1

(12) United States Patent
Keith

(10) Patent No.: US 6,691,335 B1
(45) Date of Patent: Feb. 17, 2004

(54) HAIR RINSING APPARATUS

(76) Inventor: Susan L. Keith, 2167 Wilma Rudolph Blvd., Clarksville, TN (US) 37040

( * ) Notice: Subject to any disclaimer, the term of this patent is extended or adjusted under 35 U.S.C. 154(b) by 0 days.

(21) Appl. No.: 10/289,584

(22) Filed: Nov. 7, 2002

(51) Int. Cl.[7] ..... A45D 19/02; A45D 19/14
(52) U.S. Cl. ..... 4/518; 4/515; 132/212
(58) Field of Search ..... 4/515, 518, 520, 4/521, 522, 523; 2/174; 132/212, 272

(56) References Cited

U.S. PATENT DOCUMENTS

| | | | | |
|---|---|---|---|---|
| 2,812,519 A | * | 11/1957 | Parks | 4/518 |
| 2,856,918 A | * | 10/1958 | Kingery et al. | 4/518 X |
| 3,044,473 A | * | 7/1962 | Cover | 132/212 |
| 3,692,066 A | * | 9/1972 | Fava | 132/212 |
| 3,732,580 A | | 5/1973 | Ernesto | |
| 4,078,557 A | | 3/1978 | Spencer | |
| 4,769,861 A | * | 9/1988 | Chang | 4/515 |
| 4,817,218 A | | 4/1989 | Dimitriu et al. | |
| 4,987,618 A | | 1/1991 | Tolbert | |
| 5,075,908 A | | 12/1991 | Newman | |
| 5,235,709 A | | 8/1993 | Terlep | |
| D347,491 S | | 5/1994 | Holloway | |
| D348,748 S | | 7/1994 | Zirnheld, Jr. | |
| 5,337,423 A | | 8/1994 | Young | |

* cited by examiner

*Primary Examiner*—Robert M. Fetsuga
(74) *Attorney, Agent, or Firm*—Dale J. Ream

(57) ABSTRACT

A hair rinsing apparatus includes a liquid impervious helmet having a hemispherical configuration for partially covering a user's head. An inflatable air bladder extends along a continuous peripheral edge of the helmet for establishing a watertight seal between the peripheral edge and the user's head. The apparatus includes an air pump that may be releasably coupled to the air bladder with a needle valve and needle valve receptacle combination for selectively inflating or deflating the air bladder. The apparatus includes a hose that may be connected to a helmet input port. A plurality of rinse tubes defining a plurality of holes are positioned within the interior of the helmet and are in fluid communication with the inlet port for dispersing a water stream into the helmet as water is received through the hose. An outlet opening is extends through a rear portion of the helmet for draining water therein.

16 Claims, 6 Drawing Sheets

HAIR RINSING APPARATUS

BACKGROUND OF THE INVENTION

This invention relates generally to hair rinsing apparatus and, more particularly, to an improved hair rinsing apparatus which allows selective inflation of an air bladder seal about an individual's hairline while a water stream is dispersed within an impervious helmet for rinsing the individual's hair.

An individual's hair must be thoroughly rinsed as part of the hairstyling procedure associated with a hair permanent. This rinsing procedure, which may take from 3 to 8 minutes depending on the type of perm being given, is a time-consuming task that is dreaded by many hairstylists as they would prefer to have their hands free to perform other tasks.

Although various rinsing devices have been proposed in the art, the existing devices do not provide the hairstylist with maximum control and convenience concerning the prevention of leakage of rinse water from the device. In addition, the existing devices do not provide sufficient neck or head support or comfort to an individual reclined into the hairstylist's sink bowl.

Therefore, it would be desirable to have a hair rinsing apparatus having an air bladder which may be selectively inflated or deflated by a hairstylist to establish a desired watertight seal between the rinsing shell and an individual's head, regardless of head size. Further, it would be desirable to have a hair rinsing apparatus having internal and external head and neck support members for a user's comfort when reclined over the hairstylist's sink bowl. In addition, it is desirable to have a hair rinsing apparatus in which a hose and nozzle may be used independently or in combination with the rinsing shell to rinse an individual's hair.

SUMMARY OF THE INVENTION

A hair rinsing apparatus according to the present invention includes a liquid impervious shell having a generally hemispherical configuration for partially covering a user's head. The shell, also referred to as a helmet, includes a continuously extending peripheral edge that defines front and bottom openings through which a user's head may be received into an interior space of the shell. An air bladder extends along the peripheral edge and may be selectively inflated by the hairstylist using a bulb-type hand pump. The selectively inflatable air bladder allows the hair rinsing apparatus to be utilized comfortably with individuals having various head sizes. The apparatus also includes a plurality of rinse tubes positioned within the rinse shell, each rinse tube defining a plurality of spaced apart holes. Each tube is connected in fluid communication with an inlet port of the shell. Therefore, as a water stream is directed to the inlet port, the water stream is distributed into the rinse tubes and dispersed through the plurality of rinse tube holes so as to rinse the user's hair. A rear portion of the shell defines one or more openings for efficiently draining water from the shell continuously during a rinsing process. A padded headrest is positioned within the rinsing shell for comfortably supporting an individual's head when reclined over the hairstylist's sink bowl. A neck support extends from a rearward portion of the shell's peripheral edge and is configured both to support an individual's neck and to nest with the hairstylist's sink bowl.

Therefore, a general object of this invention is to provide a hair rinsing apparatus which seals rinse water away from the face of an individual during a rinse procedure.

Another object of this invention is to provide a hair rinsing device, as aforesaid, having an air bladder positioned along a peripheral edge of a rinsing shell that may be selectively inflated to form a desired watertight seal.

Still another object of this invention is to provide a hair rinsing apparatus, as aforesaid, in which the rinsing shell includes a padded headrest for supporting a user's head when reclined over a hairstylist's sink bowl.

Yet another object of this invention is to provide a hair rinsing apparatus, as aforesaid, which includes a neck support extending from the rinsing shell for supporting a user's neck when reclined and which nests with the hairstylist's sink bowl.

A further object of this invention is to provide a hair rinsing apparatus, as aforesaid, having a hose attachment and nozzle for rinsing a user's hair which may be used independently or in combination with a rinsing shell.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
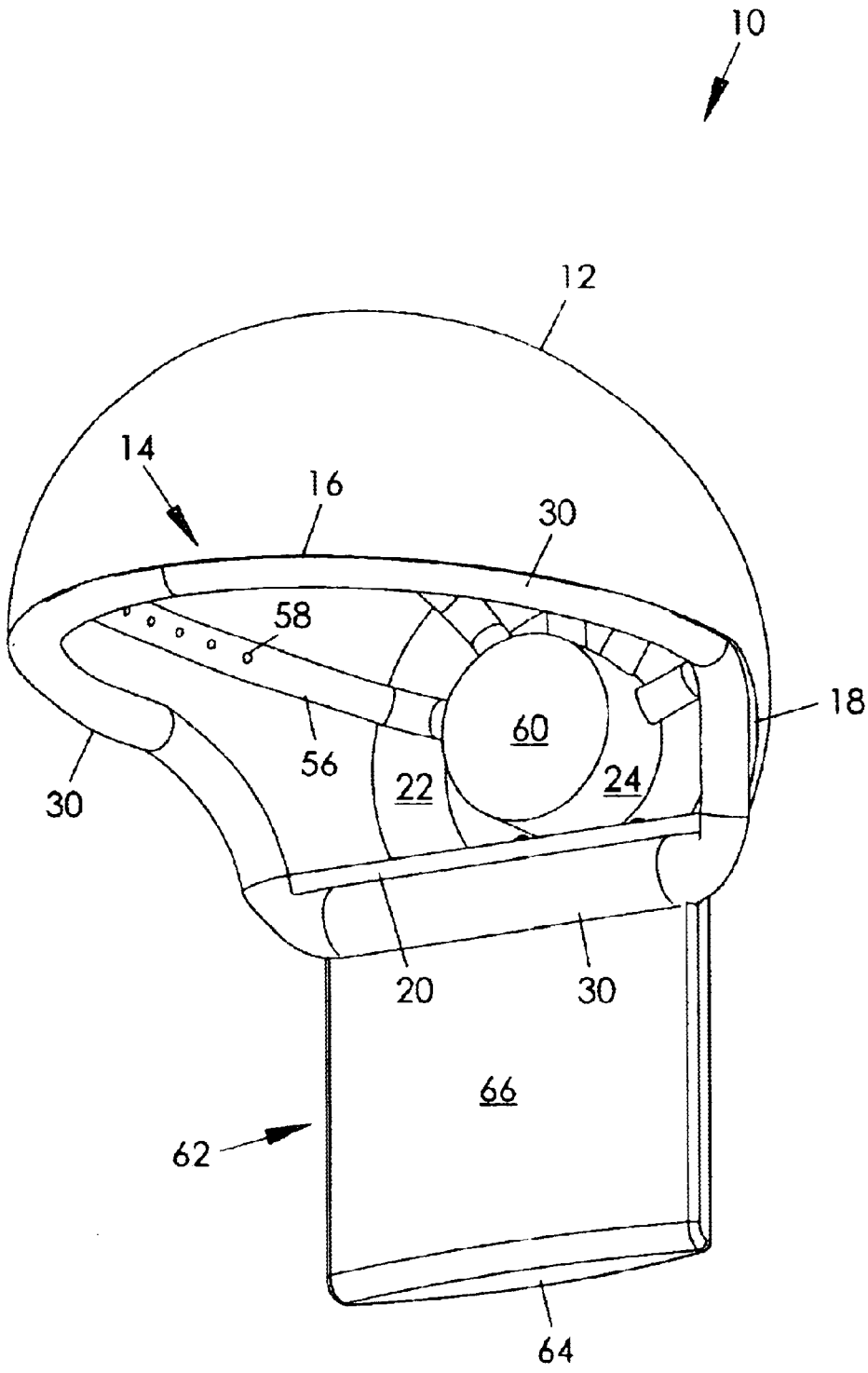
FIG. 1 is a front perspective view of a hair rinsing apparatus according to a preferred embodiment of the present invention with pump and hose accessories removed.

A hair rinsing apparatus 10 according to a preferred embodiment of the present invention will now be described in detail with reference to FIGS. 1 through 6 of the accompanying drawings. The hair rinsing apparatus 10 includes a rinsing shell 12 having a generally hemispherical configuration (FIG. 1). The rinsing shell 12 will also be referred to herein as a rinsing helmet as its preferred configuration generally resembles that of a helmet. Therefore, the rinsing shell 12 defines an interior space in which other components are mounted, as to be described more fully later. The rinsing helmet/shell 12 is constructed of a rigid, liquid impervious material such as molded nylon. The rinsing shell 12 includes a continuously extending peripheral edge 14 defining an open front and bottom through which a user's head may be received. For further clarity, the peripheral edge 14 includes a front portion 16, opposed side portions 18, and a rear portion 20. It is understood that these openings may be relatively large as the sealing mechanism to be described more fully below will establish a selectively snug fit. The side portions 18 of the peripheral edge 14 are rearwardly positioned such that a user's ears remain outside the rinsing shell 12 in use.

Figure 4:
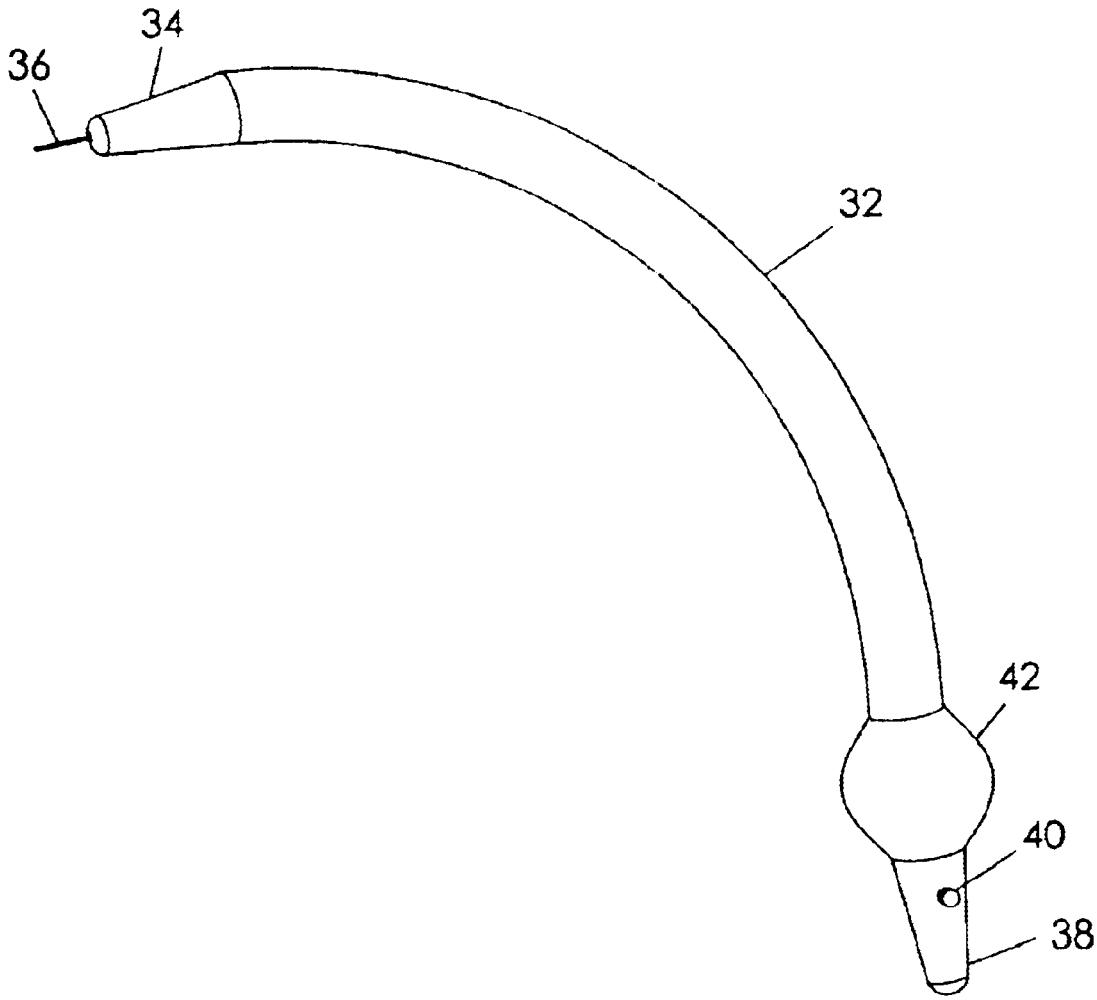
FIG. 4 is a perspective view of a pump according to the preferred embodiment of the present invention.
Figure 5:
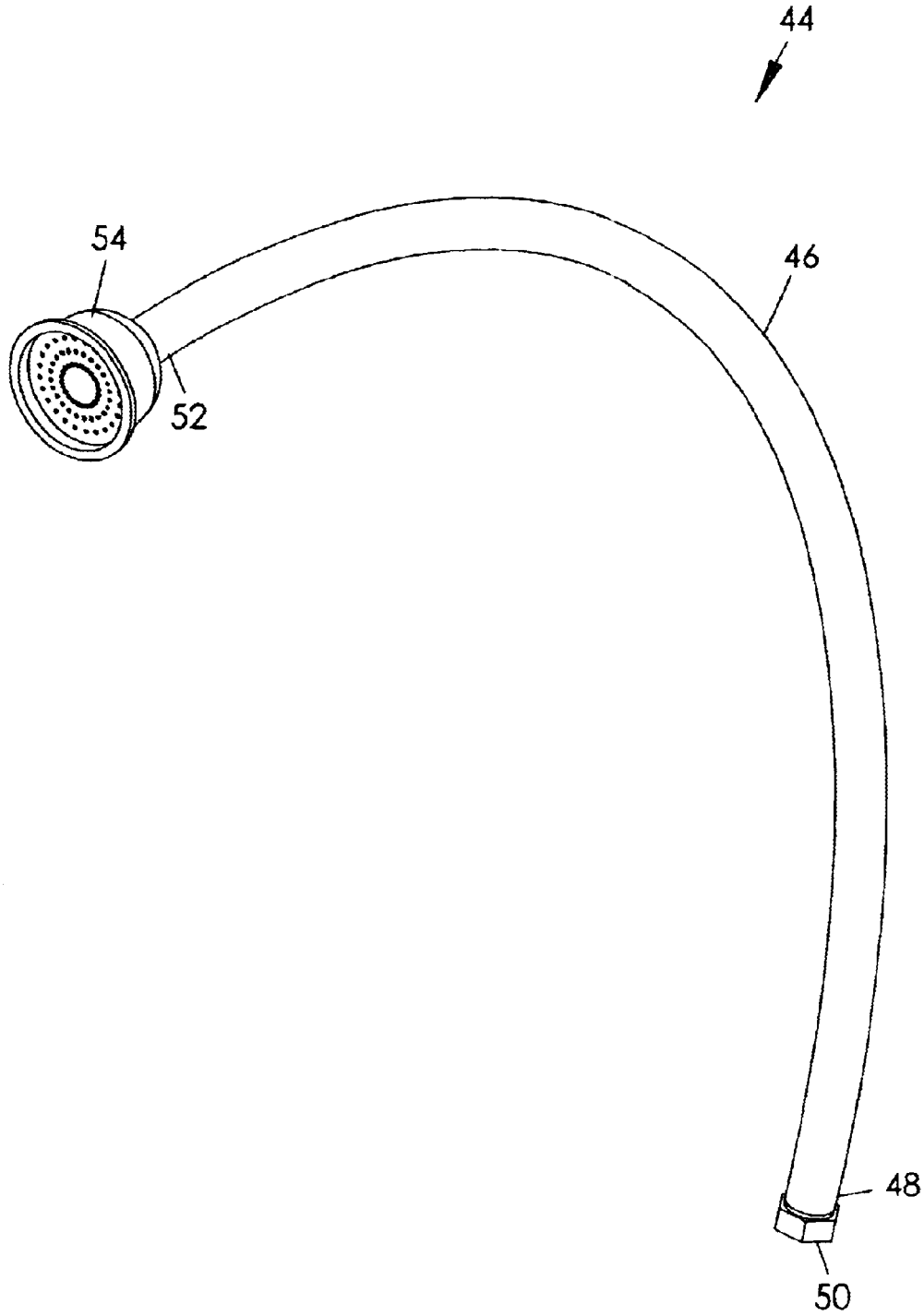
FIG. 5 is a perspective view of a hose assembly according to the preferred embodiment of the present invention.
Figure 6:
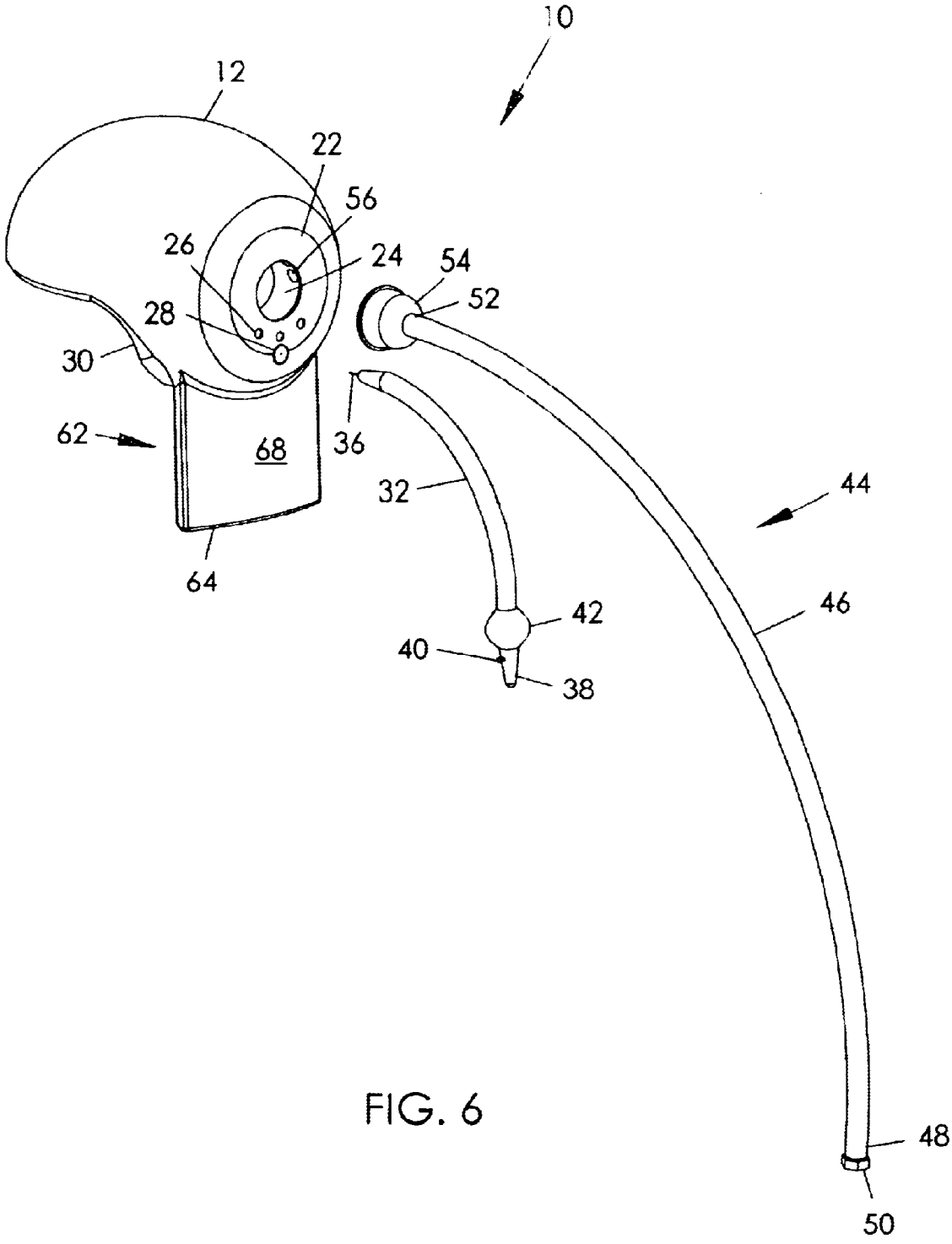
FIG. 6 is an exploded rear perspective view of the hair rinsing apparatus according to the preferred embodiment of the present invention.

An inflatable air bladder 30 is attached to the peripheral edge 14 of the rinsing shell 12 and extends continuously therealong. Preferably, the air bladder 30 is constructed of a thermoplastic elastomer or another polymer material with similar durability and elastomeric characteristics. A needle valve receptacle 28 is mounted to a rear wall 22 of the rinsing shell 12 and is connected to the air bladder 30 for communication of air therebetween. The hair rinsing apparatus 10 includes a generally tubular pump 32 having a needle valve 36 at a first end 34 and an air release valve 40 adjacent a second end 38 (FIG. 4). The pump 32 includes an air bulb 42 intermediate the first 34 and second 38 ends that pushes air through the needle valve 36 when the bulb 42 is squeezed by a user. Therefore, squeezing the bulb 42 pushes air into the air bladder 30 when the needle valve 36 is inserted into the needle valve receptacle 28 and air may be released from the air bladder 30 upon appropriate manipulation of the air release valve 40. Inflating the air bladder 30 enables the air bladder 30 to establish a watertight seal or barrier between the peripheral edge 14 and a user's head and, therefore, prevents leakage. Of course, other pumping means would also be suitable, such as an electric pump, a manual foot pump, or the like.

The rinsing helmet/shell 12 further includes an inlet port 24 recessed in the rear wall 22 thereof (FIG. 2), although placement at another point on the shell 12 would also work. The hair rinsing apparatus 10 also includes a hose assembly 44 (FIG. 5) having a flexible hose 46 with a coupling 50 at a first end 48 for connection to a conventional water source such as a faucet, or to another desired fluid source. A nozzle 54 is connected to a second end 52 of the hose 46 for dispersing a water stream in a predetermined pattern. The configuration of the nozzle 54 is complementary to a configuration of the recessed inlet port 24 described above such that the nozzle 54 may be received and held in the inlet port 24 in a friction fit relationship for quick coupling or uncoupling. Of course, a snap-fit or latch arrangement would also be suitable. It should be appreciated that the hose 46 and nozzle 54 may selectively be used independently to rinse a user's hair or inserted into the inlet port 24 for conveying a water stream to the rinsing shell 12 for use as described below.

Figure 3:
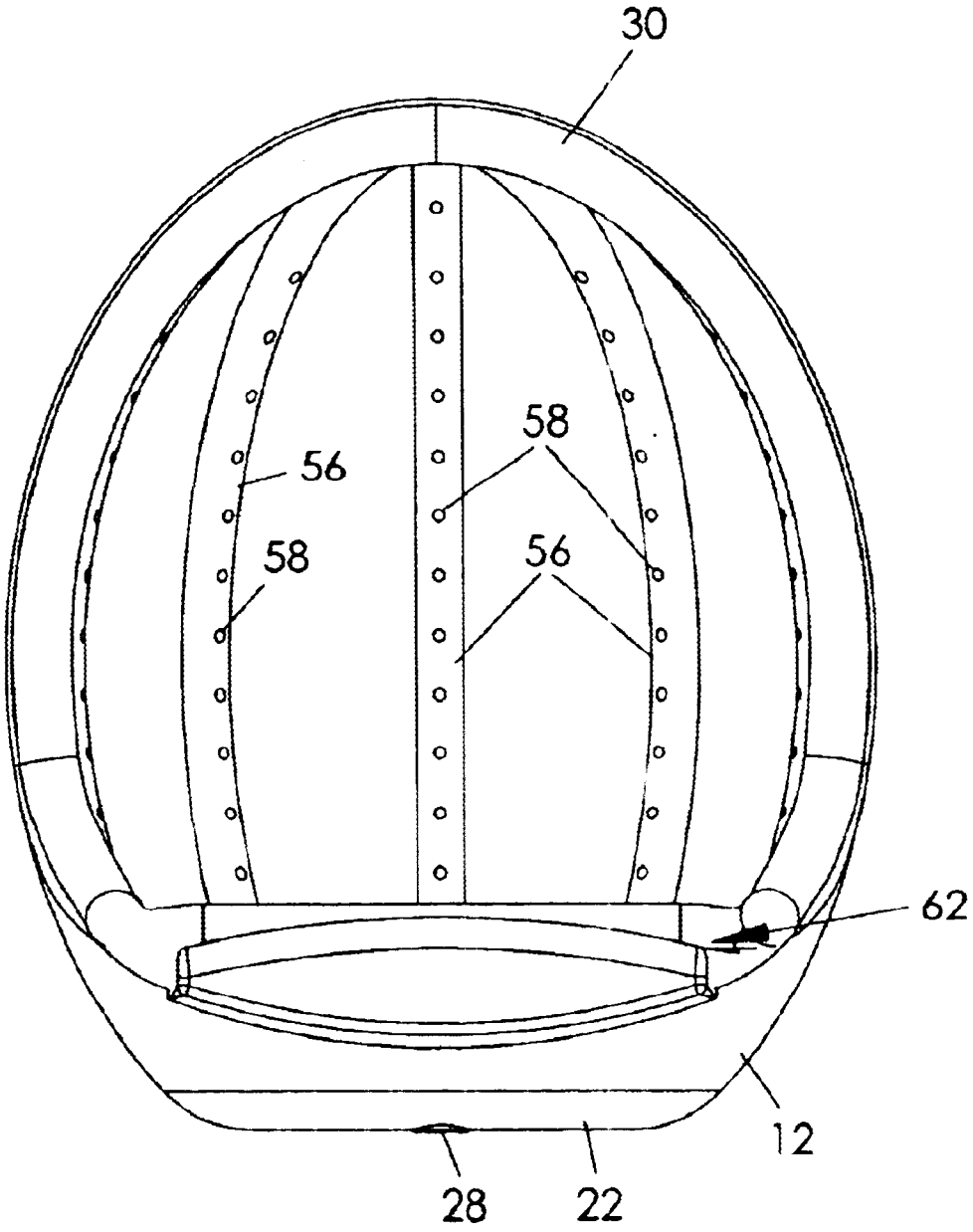
FIG. 3 is a bottom view of the apparatus as in FIG. 1.

The hair rinsing apparatus 10 further includes a fluid bladder positioned within the interior space of the rinsing shell 12 (FIGS. 1 and 3). More particularly, the fluid bladder includes a plurality of rinse tubes 56, each rinse tube defining a plurality of spaced apart holes 58. Each rinse tube 56 is coupled to the inlet port 24 for fluid communication therewith, the tubes being radially positioned thereabout for even distribution of the water stream onto a user's hair (FIG. 1).

The rear wall 22 of the rinsing helmet/shell 12 also defines at least one, but preferably a plurality, of outlet openings 26 for draining water from the interior space during use. The outlet openings 26 are positioned at the rear wall 22 as it is presumed that the user and rinsing shell 12 will be reclined over the hairstylist's sink bowl during use and thus when drainage would be needed.

A headrest 60 is mounted to the back of the inlet port 24 within the interior space of the rinsing shell 12 (FIG. 1). This position is adjacent the rear portion 20 of the peripheral edge 14. The headrest is constructed of a padded material so as to comfortably support the head of an individual being reclined during a rinsing procedure. The headrest 60 includes a circular configuration although other shapes that would support the back of person's head would also be suitable. It should also be appreciated that the headrest 60 may be mounted to a rear wall or other structure of the helmet/shell 12 if the inlet port 24 was also alternatively positioned.

Figure 2:
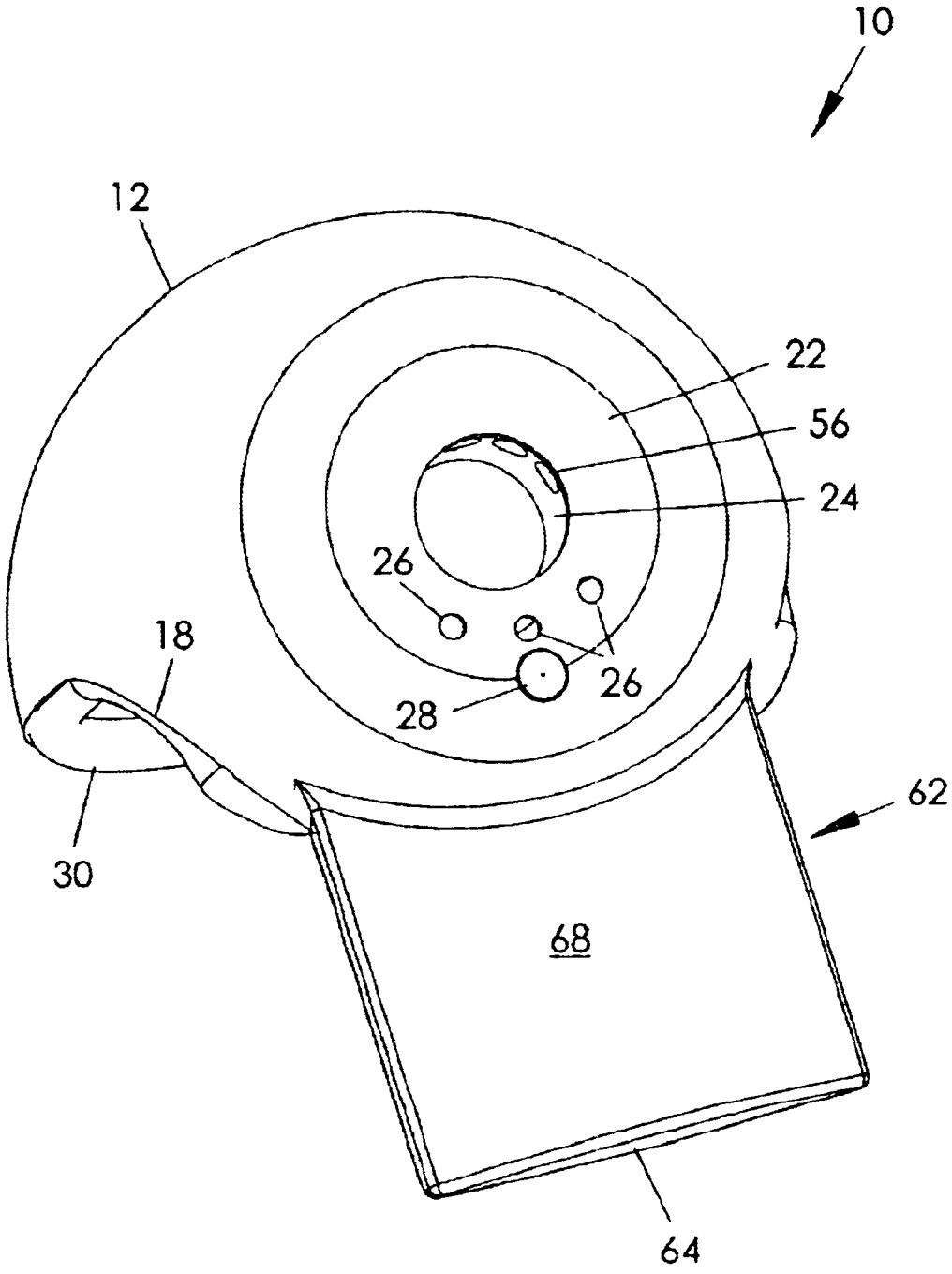
FIG. 2 is a rear perspective view of the apparatus as in FIG. 1.

A neck support 62 is fixedly attached along one edge to the rear portion 20 of the peripheral edge 14 (FIG. 2). The neck support 62 depends from the rear portion 20 of the peripheral edge 14 and includes a free edge 64 that may be coupled to a hairstylist chair. Preferably, a front surface 66 of the neck support 62 includes a padded construction having a convex configuration for supporting the neck of a user in a reclined position (FIG. 1). Similarly, a back surface 68 of the neck support 62 also includes a convex configuration that is complementary to a conventional concave or cutout portion at the front edge of a hairstylist's sink bowl (not shown). This configuration allows the neck support 62 to nest in the sink bowl recess for stability. FIG. 3 best shows how both surfaces of the neck rest present convex configurations.

In use, an individual's head may be received into the interior space of the rinsing helmet/shell 12 when the individual's hair needs to be rinsed, e.g. as part of receiving a permanent. The hairstylist may then squeeze the pump bulb 42 repeatedly to inflate the air bladder 30 until it forms a watertight seal between the shell 12 and the individual's head. Of course, the air release valve 40 on the pump 32 may be operated to release air from the air bladder 30 should it be inflated too far at first. The individual, presumably seated in a hairstylist chair, may then be reclined along with the hair rinsing apparatus 10 over the hairstylist's sink. The head and neck of the individual are comfortably supported by the headrest 60 and neck support 62. If the nozzle 54 of the hose 46 is not yet connected to the inlet port 24, it may be so connected and the water stream may be started. The water stream will then flow into the interior space of the shell 12 and rinse the individual's hair. The water will drain through the outlet openings 26. The hairstylist is free to do other tasks while the rinsing procedure proceeds. When finished, the individual may be returned to an upright position and the rinsing shell 12 may be removed by first releasing the air from the air bladder 30. Should any additional rinsing be required, the hose 46 may be released from the inlet port 24 and used independently of the rest of the apparatus 10.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A hair rinsing apparatus, comprising:

a liquid impervious shell for partially covering a user's head having a continuous peripheral edge defining an opening through which the user's head may be received into said shell, said shell having an inlet port;

an air bladder extending along said peripheral edge of said shell;

means for selectively inflating said air bladder for establishing a fluid-tight securement of said air bladder between said peripheral edge and the user's head;

a fluid bladder positioned in said shell in fluid communication with said inlet port, said fluid bladder defining a plurality of holes for dispersing a fluid from said fluid bladder into said shell;

wherein said fluid bladder includes a plurality of rinse tubes connected to said inlet port in fluid communication therewith, said plurality of holes being spaced apart along said plurality of rinse tubes; and wherein said shell defines an outlet opening for draining said fluid from said shell.

2. The hair rinsing apparatus as in claim 1 wherein said inflating means includes:

a pump having a needle valve and an air bulb for selectively manually pumping air through said needle valve;

a needle valve receptacle coupled to said shell in communication with said air bladder for releasably receiving said needle valve therein; and an air release valve on said pump for selectively releasing air from said air bladder when said needle valve is received in said needle valve receptacle.

3. The hair rinsing apparatus as in claim 1 further comprising a headrest positioned in said shell adjacent a rearward portion of said peripheral edge, said headrest having a padded construction for supporting the user's head thereon.

4. The hair rinsing apparatus as in claim 1 further comprising a neck support fixedly attached to a rearward portion of said peripheral edge and depending therefrom, said neck support including a front surface having a convex configuration and a rear surface having a convex configuration complementary to a configuration of a hairstylist sink bowl.

5. The hair rinsing apparatus as in claim 1 fiber comprising a hose having an inlet end for releasable connection to a fluid supply source and an outlet end for releasable connection to said inlet port of said shell for transporting a fluid stream from said fluid supply source to said fluid bladder.

6. The hair rinsing apparatus as in claim 5 wherein said outlet end of said hose includes a nozzle for dispersing said fluid stream, said nozzle adapted to mate with said inlet port of said shell in a friction fit relationship.

7. A hair rinsing apparatus, comprising:

a liquid impervious helmet having a generally hemispherical configuration defining an interior space, said helmet having a continuous peripheral edge defining an open front and bottom through which a user's head may be received into said interior space, said helmet having an inlet port;

a hose having an inlet end for releasable connection to a water supply line and an outlet end for releasable connection to said inlet port of said helmet, said hose adapted to transport a water stream from said water supply line to said inlet port;

an inflatable air bladder extending continuously along said peripheral edge of said helmet;

a pump releasably coupled to said air bladder for selectively inflating said air bladder to establish a watertight seal between said peripheral edge and the user's head;

a plurality of rinse tubes positioned in said interior space of said helmet and defining a plurality of holes therealong, said plurality of rinse tubes being in fluid communication with said inlet port and arranged radially thereabout for dispensing said water stream into said interior space of said helmet; and wherein a rear wall of said helmet defines an outlet opening for draining said water stream from said interior space of said helmet.

8. The hair rinsing apparatus as in claim 7 further comprising:

a needle valve receptacle attached to said helmet and being in communication with said air bladder;

wherein said pump includes a needle valve and an air bulb whereby air is forced through said needle valve upon a user squeezing said air bulb; and wherein said pump includes an air release valve for selectively releasing air from said air bladder.

9. The hair rinsing apparatus as in claim 7 further comprising a headrest positioned in said interior space of said helmet adjacent a rearward portion of said peripheral edge, said headrest having a padded construction for supporting the user's head thereon.

10. The hair rinsing apparatus as in claim 9 further comprising a neck support fixedly attached to said rearward portion of said peripheral edge and depending therefrom, said neck support including a front surface having a convex configuration for supporting a user's neck and a rear surface having a convex configuration complementary to a configuration of a hairstylist sink bowl.

11. The hair rinsing apparatus as in claim 7 further comprising a neck support fixedly attached to a rearward portion of said peripheral edge and depending therefrom, said neck support including a padded front surface having a convex configuration for supporting a user's neck and a rear surface having a convex configuration complementary to a configuration of a hairstylist sink bowl.

12. The hair rinsing apparatus as in claim 7 wherein said inlet port is positioned on said rear wall of said helmet adjacent said outlet opening.

13. The hair rinsing apparatus as in claim 7 wherein said outlet end of said hose includes a nozzle for dispersing said water stream, said nozzle adapted to releasably mate with said inlet port of said helmet in a friction fit relationship, whereby said hose and said nozzle may be used to rinse a user's hair when said helmet is not in use upon the user's head.

14. A hair rinsing apparatus, comprising:

a liquid impervious helmet having a generally hemispherical configuration defining an interior space, said helmet having a continuous peripheral edge defining an open front and bottom through which a user's head may be received into said interior space, said helmet having an inlet port;

a hose having an inlet end for releasable connection to a water supply line and an outlet end for releasable connection to said inlet port of said helmet, said hose adapted to transport a water stream from said water supply line to said inlet port;

an inflatable air bladder extending continuously along said peripheral edge of said helmet;

a pump releasably coupled to said air bladder for selectively inflating said air bladder to establish a watertight barrier between said peripheral edge and the user's head;

a plurality of rinse tubes positioned in said interior space of said helmet and defining a plurality of holes therealong, said plurality of rinse tubes being in fluid communication with said inlet port and arranged radially thereabout for dispensing said water stream into said interior space of said helmet;

wherein a rear wall of said helmet defines a plurality of outlet openings for draining said water stream from said interior space of said helmet;

a headrest positioned in said interior space of said helmet adjacent a rearward portion of said peripheral edge, said headrest having a padded construction for supporting the user's head thereon; and a neck support depending from said rearward portion of said peripheral edge and having a free edge for connection to a hairstylist chair, said neck support including a padded front surface having a convex configuration for supporting a user's neck and a rear surface having a convex configuration complementary to a configuration of a hairstylist sink bowl.

15. The hair rinsing apparatus as in claim 14 wherein said outlet end of said hose includes a nozzle for dispersing said water stream, said nozzle adapted to releasably mate with said inlet port of said helmet in a friction fit relationship, whereby said hose and said nozzle may be used to rinse the user's hair when said helmet is not in use upon the user's head.

16. The hair rinsing apparatus as in claim 14 further comprising:

a needle valve receptacle attached to said helmet and in communication with said air bladder;

wherein said pump includes a needle valve and an air bulb whereby air is forced through said needle valve upon a user squeezing said air bulb; and wherein said pump includes an air release valve for selectively releasing air from said air bladder.

* * * * *